US006064954A

United States Patent [19]

Cohen et al.

[11] Patent Number: 6,064,954

[45] Date of Patent: May 16, 2000

[54] DIGITAL AUDIO SIGNAL CODING

[75] Inventors: Gilad Cohen, Haifa; Yossef Cohen, Nesher; Doron Hoffman, Kiryat Motzkin; Hagai Krupnik; Aharon Satt, both of Haifa, all of Israel

[73] Assignee: International Business Machines Corp., Armonk, N.Y.

[21] Appl. No.: 09/034,516

[22] Filed: Mar. 4, 1998

[30] Foreign Application Priority Data

Apr. 3, 1997 [EP] European Pat. Off. ..... 97480009

[51] Int. Cl.[7] ..... G10L 19/12

[52] U.S. Cl. ..... 704/207; 704/206; 704/227; 704/219; 704/230

[58] Field of Search ..... 704/270, 500, 704/226, 222, 224, 230, 219, 203, 265, 208, 206, 220, 200, 217, 207

[56] References Cited

U.S. PATENT DOCUMENTS

| | | | |
|---|---|---|---|
| 5,596,676 | 1/1997 | Swaminathan et al. | 704/208 |
| 5,684,920 | 11/1997 | Iwakami et al. | 704/203 |
| 5,734,789 | 3/1998 | Swaminathan et al. | 704/206 |
| 5,749,065 | 5/1998 | Nishiguchi et al. | 704/219 |
| 5,828,996 | 10/1998 | Iljima et al. | 704/220 |
| 5,909,663 | 6/1999 | Iljima et al. | 704/226 |
| 5,926,768 | 7/1999 | Nishiguchi | 704/265 |

*Primary Examiner*—David R. Hudspeth
*Assistant Examiner*—Vijay B Chawan
*Attorney, Agent, or Firm*—Rabin & Champagne, PC

[57] ABSTRACT

Apparatus is disclosed for digitally encoding an input audio signal, for storage or transmission, comprising: a pitch detector for determining at least a dominant time-domain periodicity in the input signal; a generator for generating a prediction signal based on the dominant time domain periodicity of the input signal; a first discrete frequency domain transform generator for generating a frequency domain representation of the input signal; a second discrete frequency domain transform generator for generating a frequency domain representation of the prediction signal; a subtractor to subtract at least a portion of the frequency domain representation of the prediction signal from the frequency domain representation of the input signal to generate an error signal; and a generator to generate an output signal from the error signal and parameters defining the prediction signal. A corresponding decoder is also described.

31 Claims, 3 Drawing Sheets

DIGITAL AUDIO SIGNAL CODING

BACKGROUND OF THE INVENTION

1. Field of the Invention

This invention relates to the encoding of audio signals and, more particularly, to improved transform coding of digitized audio signals.

2. Background Description

The need for low bitrate and low delay audio coding, such as is required for video conferencing over modern digital data communications networks, has required the development of new and more efficient schemes for audio signal coding.

Transform coding is one of the best known techniques for high quality audio signal coding in low bitrates, because of extensive use of psychoacoustic models for noise masking. A general description of transform coding techniques can be found in "Transform Coding of Audio Signals Using Perceptual Noise Criteria", IEEE Journal of Selected Areas in Comm., February 1988, J. D. Johnston.

In the low delay case, however, transform coding is difficult to apply since the need to use a short transform results in low coding gain.

SUMMARY OF THE INVENTION

It is therefore an object of the present invention to provide a low-bitrate and low-delay transform coding technique with improved coding gain.

In brief, this object is achieved by apparatus for digitally encoding an input audio signal, for storage or transmission, comprising: pitch detection means for determining at least a dominant time-domain periodicity in the input signal; means for generating a prediction signal based on the dominant time domain periodicity of the input signal; first discrete frequency domain transform means for generating a frequency domain representation of the input signal; second discrete frequency domain transform means for generating a frequency domain representation of the prediction signal; means to subtract at least a portion of the frequency domain representation of the prediction signal from the frequency domain representation of the input signal to generate an error signal; and means to generate an output signal from the error signal and parameters defining the prediction signal.

Pitch prediction is thereby embedded within a transform coder scheme. A time domain pitch predictor is used to calculate a prediction of the current input signal segment. The prediction signal is then transformed to get a transform domain prediction for the input signal transform. The actual coding is applied to the prediction error of the transform, thereby allowing for lower quantization noise for a given bitrate.

Other features of preferred embodiments relate to the transform coefficient quantization scheme, using an adaptive entropy-coding/vector-quantization technique. These features are presented in the following detailed description.

The invention also provides corresponding decoding apparatus and methods of encoding and decoding audio signals.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENTS OF THE INVENTION

Figure 1:
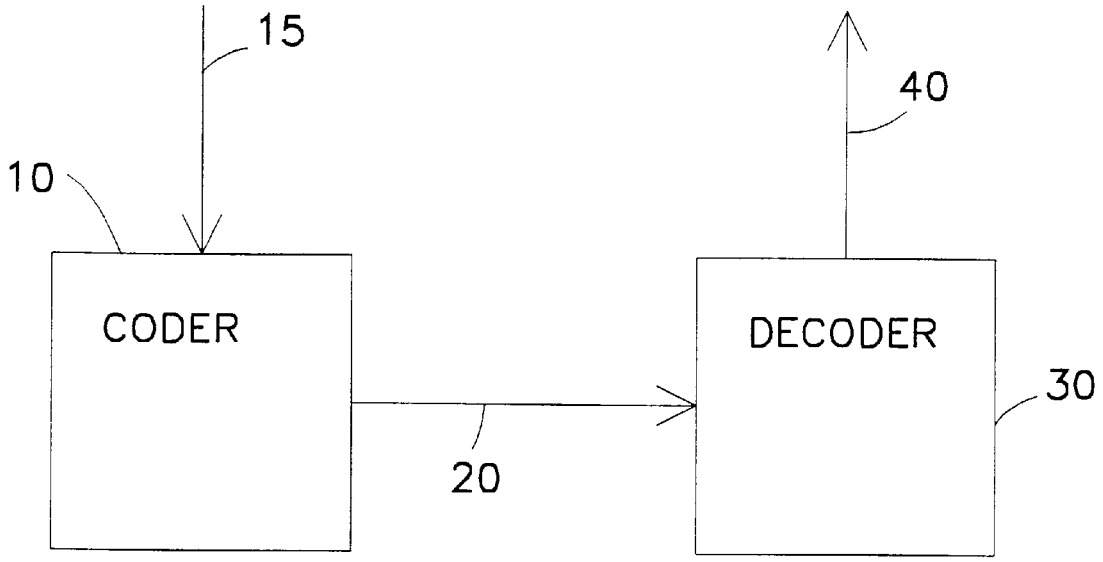
FIG. 1 shows in generalized and schematic form an audio signal coding system.

FIG. 1 shows a generalized view of an audio signal coding system. Coder 10 receives an incoming digitized audio signal 15 and generates from it a coded signal. This coded signal is sent over transmission channel 20 to decoder 30 wherein an output signal 40 is constructed which resembles the input signal in relevant aspects as closely as is necessary for the particular application concerned. Transmission channel 20 may take a wide variety of forms including wired and wireless communication channels and various types of storage devices. Typically, transmission channel 20 has a limited bandwidth or storage capacity which constrains the bit rate, ie the number of bits required per unit time of audio signal, for the coded signal.

Figure 2:
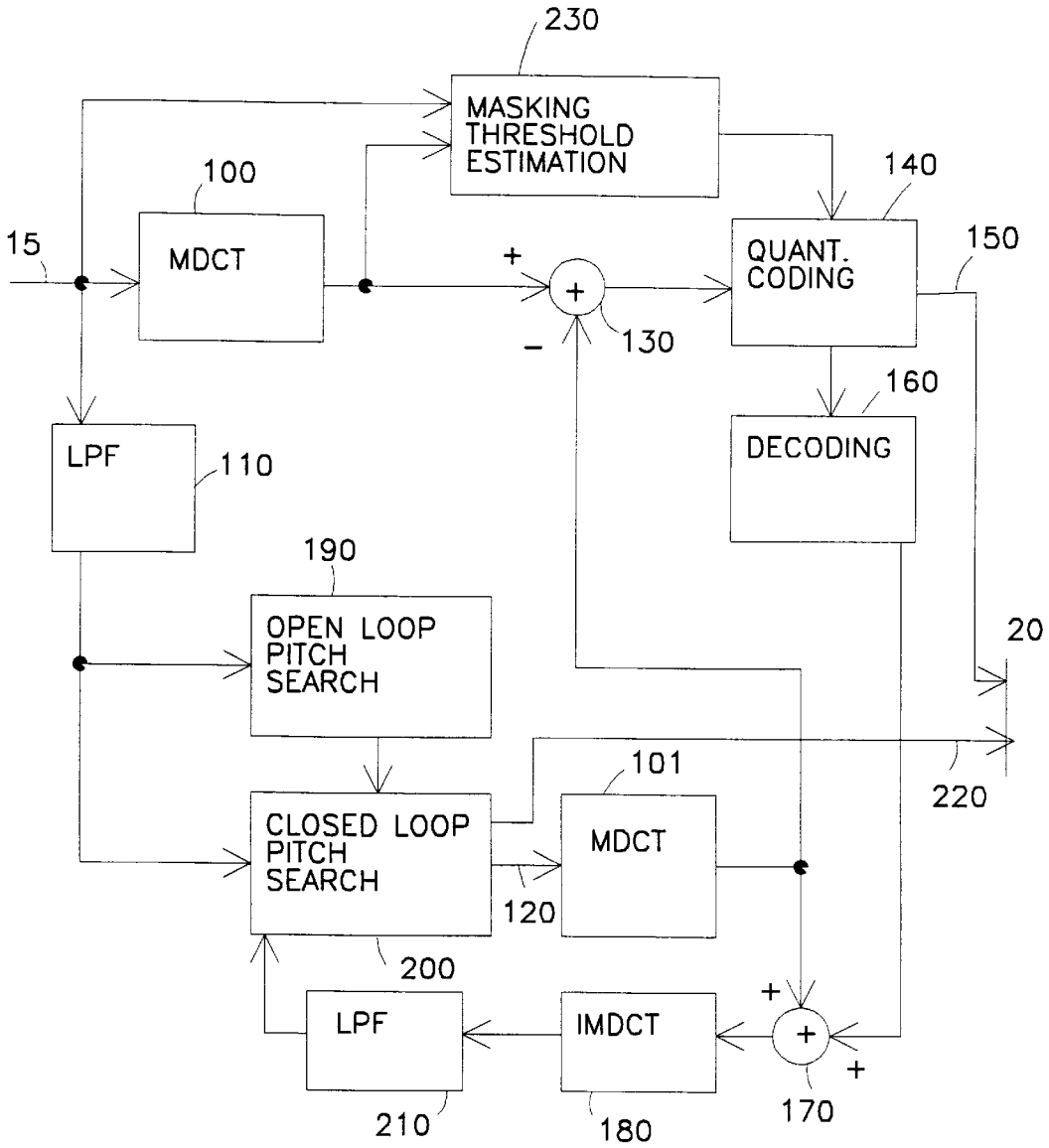
FIG. 2 is a schematic block diagram of a transform coder.

FIG. 2 is a schematic diagram showing coder 10 in a preferred embodiment of the invention. Input signal 15 is fed simultaneously into a conventional modified Discrete Cosine Transform (MDCT) circuit 100 and low pass filter circuit 110. Input signal 15 is a digitized audio signal, which may include speech, at the illustrative sampling rate and bandwidth of 16 KHz and 7 KHz respectively. Whilst the MDCT is employed in this embodiment, it will be appreciated that other similar frequency domain transforms such as non-overlapped DCT, DFT or other lapped transforms may be used. A general description of these techniques can be found in "Lapped Transforms for Efficient Transform/Subband Coding", H. Malvar, IEEE trans. on ASSP, vol. 37, no. 7, 1989.

Illustratively, the transform frame size is 160 samples or 10 milliseconds, and the overlapping window length is 320 samples. The MDCT circuit 100 transforms 320 samples of the signal, resulting in 160 MDCT coefficients. The first 160 signal samples of the current frame are denoted by x(0), x(1), . . . x(159), and the next 160 samples which are the first samples of the next frame are x(160), . . . x(319). In the previous frame, the signal samples x(−160), . . . x(−1), x(0), . . . x(159), are required to produce the 160 MDCT coefficients.

MDCT circuit 101, which is identical to MDCT circuit 100, receives 320 input samples of a prediction signal 120 which is generated from previous frames as described below, and transforms them into 160 coefficients, which will be referred to as the prediction MDCT. These coefficients are subtracted from the input signal MDCT via adder device 130. Not all the 160 prediction coefficients need be subtracted from the input MDCT. In the preferred embodiment, only the low-frequency coefficients where the prediction gain is high are subtracted from the input MDCT.

The output of the adder 130 will be referred to as the prediction error MDCT coefficients. They are fed into quantizer 140 which quantizes the coefficients, and produces the main output bitstream 150 that carries the quantization data. In addition, the quantization data is transferred to decoding circuit 160, that decodes it and provides 160 coefficients, which will be referred to as the quantized prediction error MDCT. These coefficients are added to the prediction MDCT by adder device 170. The output of device 170 the quantized signal MDCT, is fed in to IMDCT circuit 180, which inverse transforms it into output quantized signal, x'(0), . . . x'(319). This output signal is an accurate replication of the output which would be produced by decoder 30 in the absence of errors introduced by transmission channel 20. Due to the overlapping window operation, only the first 160 samples are fully reconstructed, and samples x'(160), . . . x'(319) will be finally available after processing of the next frame.

In order to generate the prediction signal 120, input signal 15 is filtered via low pass filter circuit 110, which in this embodiment limits the bandwidth to 4 KHz. The low-passed signal is fed into open loop pitch search unit 190. A variety of techniques are known for pitch detection. A general description of these can be found in Digital Processing of Speech Signals, L. R. Rabiner and R. W. Schafer, Englewood Cliffs, Prentice Hall, 1978.

In this embodiment, the 320 low passed samples of the current frame are correlated with the same 320 low passed samples at integer shifts of PitchMin, PitchMin+1, . . . PitchMax, and the open loop pitch is defined as the shift where the correlation achieves its maximum value. Illustrative values for the search limits are PitchMin=40, and PitchMax=290, which roughly corresponds to the human speech pitch range.

The open loop pitch prediction is followed by closed loop pitch prediction in unit 200. In the preferred embodiment, the closed loop prediction method used is similar to prediction techniques conventionally employed in CELP coders. An example of such a technique can be found in "Toll Quality 16 KB/s CELP speech coding with very low complexity", J. H. Chen, Proceedings ICASSP 1995. However, the method is used here in a different context. In this embodiment, a third order predictor is used to handle sub-sample pitch shift. Alternatively, a first order predictor could be applied to a fractional-sample shifted signal or even non-linear signal transformations may be used.

The pitch prediction is performed in circuit 200. The circuit receives the low passed input signal, the low passed version of the quantized signal of previous frames, and the open loop pitch parameter. The quantized signal filtering is performed in low pass filter circuit 210, which is identical to circuit 110.

In the preferred embodiment, the prediction process is carried out for three pitch values: OLP-1, OLP, and OLP+1, where OLP is the integer open loop pitch value. For each value, all the possible predictor vectors of third order from a predetermined list, or codebook, are checked. The pair of pitch value and predictor vector that yields the best prediction is selected. The detailed process is as follows.

For each pitch value P, a periodical extended signal is created: $x'_p(-1)$, $x'_p(0)$, . . . $x'_p(320)$, out of the low passed output signal. For a given predictor vector [p(0),p(1),p(2)], the temporary prediction signal is:

$$t(n)=p(0)x'_p(n-1)+p(1)x'_p(n)+p(2)x'_p(n+1)$$

where n=0, 1, . . . 319.

Thus the error energy is given by:

$$E=\sum_{n=0}^{319}(x_{lpf}(n)-t(n))(x_{lpf}(n)-t(n))$$

where $x_{lpf}$ is the low passed input signal. The best prediction corresponds to the lowest value of E. Given the low passed output signal $x'_{lpf}$ and pitch value P, the periodical extended signal is determined by $$x'_p(n)=x'_{lpf}((n \bmod P)-P)$$

for all n, where mod designates the modulo operation. For the purpose of the periodical extension, only past samples of the output signal or its low passed version are used: $x'_{lpf}(-1)$, $x'_{lpf}(-2)$, . . .

Once the best closed loop pitch value and predictor vector have been determined, the 320 samples of the prediction signal are given. To compensate for the filter delay of circuits 110 and 210, the prediction signal is periodically extended with the closed loop pitch value to obtain the 320 samples without delay. The closed loop pitch and the predictor index are carried in an auxiliary bitstream 220, which is encoded as side information in a manner to be described below. This information is needed to produce an exact replication of the prediction signal within decoder 30.

Figure 3:
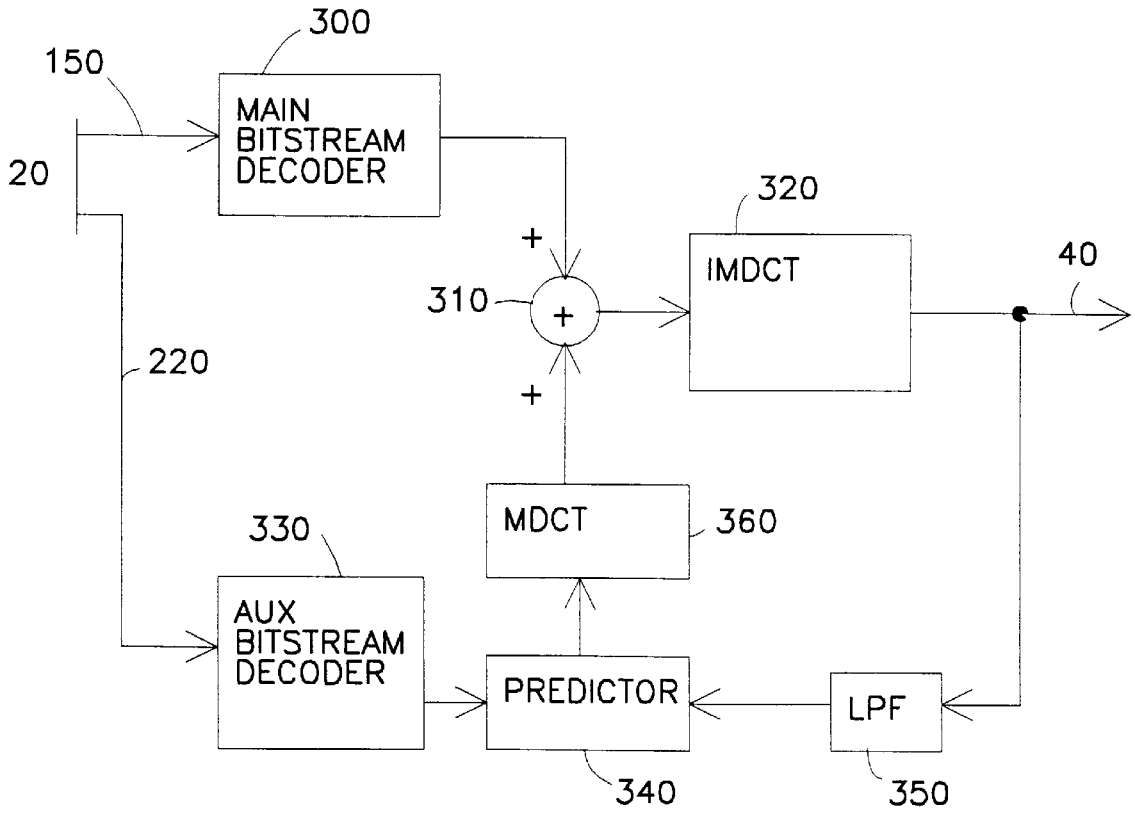
FIG. 3 is a schematic block diagram of the corresponding decoder.

FIG. 3 is a schematic diagram showing decoder 20. In the embodiment of FIG. 3, the main bitstream 150 is fed in to bitstream decoder circuit 300. It assembles the 160 coefficients of the quantized prediction error MDCT, out of the quantization data which is carried by the bitstream 150. These coefficients are added to the prediction MDCT by adder device 310. The output of device 310, the quantized signal MDCT, is fed into IMDCT circuit 320, which inverse transforms it to generate output quantized signal 40, x'(0), . . . x'(319). Due to the overlapping window operation, only the first 160 samples are fully reconstructed, and samples x'(160), . . . x'(319) will be finally available after processing of the next frame. The output signal, is an exact replication of the quantized signal in the encoder, in the absence of channel errors.

The auxiliary bitstream 220 is fed into bitstream decoder circuit 330. Bitstream decoder 330 extracts the closed loop pitch and the predictor vector information from the data which is carried by the bitstream 220. This information is used by pitch predictor circuit 340 to calculate the prediction signal from the periodic extension of output signal 40 which is filtered by the low pass filter circuit 350. MDCT circuit 360 receives the 320 samples of the prediction signal, and transforms them into 160 coefficients of prediction MDCT.

In the preferred embodiment, for each frame the pitch prediction mechanism may be operated or disabled, according to the expected benefit in terms of quantization noise or bitrate. The following criteria may, for example be used to determine whether for each frame prediction is employed: (i) High correlation value while searching for open loop pitch; (ii) Low prediction error following closed loop pitch calculation; (iii) Low prediction error in the transform domain.

If the transform domain prediction error energy is E dB, and that the unpredicted MDCT coefficient energy is T dB, then the energy reduction is T−E dB. The expected reduction in bitrate through the application of pitch prediction can be estimated as approximately 0.2*(T−E) bits saving, using for example a rule of thumb of 5 dB reduction per bit. If this estimate is greater than the cost of the side information needed to carry the pitch prediction parameters, then prediction should be applied. The prediction error within the transform domain is also used to determine adaptively the actual frequency region where the prediction is applied.

The closed loop pitch prediction in the embodiment of FIG. 2, may be applied in sub-frames. The signal at the input of circuit 200 is divided in two or more different segments, referred to as sub-frames. For each sub-frame the prediction signal is calculated separately, based on the closed loop pitch value and predictor vector which are determined individually for the sub-frame. In addition, the open loop pitch may be searched individually for each sub-frame.

The following is a description of the preferred quantization process. It will be understood that other quantization schemes may equally be applied within the embodiment of FIG. 2. In this example, the process features adaptive entropy-coding/vector quantization, with an efficient coding of side information.

In FIG. 2, Masking threshold estimator 230 produces a sequence of 160 numbers that represents an amplitude bound for quantization noise within the MDCT domain, for the current frame. Below this signal dependent threshold, the human ear is insensitive to the quantization noise. The masking threshold may be calculated based on the theory of psychoacoustics as described in "Transform Coding of Audio Signals Using Perceptual Noise Criteria", IEEE Journal of Selected Areas in Comm., February 1988, J. D. Johnston. The masking curve is computed in 16 to 20 points equally spaced in Bark scale, and quantized with less than 20 bits, as described below. The information of the quantized masking curve is sent to the decoder. This curve is then parsed into 160 uniformly spaced frequencies using interpolation or piece-wise constant expansion.

In the preferred embodiment, the 160 coefficients of the prediction error MDCT, or the input signal MDCT, if no prediction is applied, are divided by the respective 160 numbers of the quantized masking threshold, yielding a normalized MDCT series S(0), . . . S(159). During decoding, the quantized normalized MDCT is multiplied by the quantized masking threshold, in order to restore the quantized MDCT coefficients.

To preserve a bandwidth of 7 KHz, only the first 140 coefficients are quantized and S(140), . . . S(159) are set to zero. The series S(0) to S(139) is divided into eight groups of 16 to 20 coefficients.

Illustratively, the information carried over the main bitstream 150 of FIG. 2, consists of the following data for each 10 millisecond frame:

(i) a pitch indicator bit, indicates the presence of pitch prediction;

(ii) a masking curve at less than 20 bits, via predictive vector quantization;

(iii) a gain value at 6 bits;

(iv) bit allocation information for the eight groups at about 10 bits;

(v) the average log-gain of the normalized MDCT over groups at 3 bits;

(vi) packed quantization data of the 140 normalized coefficients divided in eight groups, using the remaining bits.

The bits allocated for the coefficient quantization are divided among the eight groups, such that the noise energy of the normalized MDCT is about equal over all the groups. This way, the masking curve is uniformly approached over all frequencies, depending on the amount of bits available. A variety of techniques for bit allocation are known and may be used. In the preferred embodiment, the bit allocation is performed as follows.

The average log-gain G of the normalized MDCT over groups, is given by $$G = (0.5/L) \sum_{allgroups} \log_2(enrg(j))$$

where enrg(j) is the j-th group energy, $\log_2$ denotes binary logarithm, L is the number of groups, and the sum is over all groups. The preliminary number of bits $b_{pre}$ for the i-th group is:

$$b_{pre}=(1/L)b_{tot}+0.5\ \log_2(enrg(i))-G$$

where $b_{tot}$ is the total number of bits to be distributed among the groups.

This preliminary information is vector quantized. For the eight group case, 10 bits provide sufficient accuracy. The quantization tables are separately optimized for the two cases—with and without pitch prediction. The quantization information is sent to the decoder.

The average log-gain is quantized via scalar quantization and sent to the decoder to enable calculation of the gain value of each group in the decoder.

Certain constraints are applied to the quantized bit allocation. These are non-negative allocation, and certain maximum and minimum values for specific groups. This process is also performed in the decoder.

Quantization is performed starting from the lowest frequency group in increasing order, and surplus bits are propagated according to specific rules that can be replicated in the decoder.

Within each group that is allocated a high number of bits, typically above two bits per coefficient, scalar quantization is used, followed by entropy coding. This provides high accuracy at moderate complexity. In other groups that receive two bits or less, vector quantization is applied, which is more efficient for coarse quantization.

In the preferred embodiment, gain-adaptive vector quantization as described in Vector Quantization and Signal Processing, A. Gersho and R. M. Gray, Kluwer Academic Publishers, is applied to quadruples of coefficients, that is four to five vectors within each group. The bit allocation is rounded to the nearest codebook size among the available codebooks. The quantized gain value of each group, needed for the gain-adaptive scheme, is calculated from the quantized bit allocation value and the average log-gain, as follows.

$$\text{quantized}(\text{loggain}(i))=\text{quantized}(b_{pre}(i)+\text{quantized}(G)-(1/L)b_{tot}.$$

Further enhancement of the vector quantization is gained by adaptively splitting each group. When the energy ratio of one half of each group to the other half exceeds certain ratio, the bit allocation for the higher energy half is increased at the expense of the low energy half, and codebook sizes are changed accordingly. This splitting is designated by one bit per vector-quantized group on the bitstream. In case of active splitting, an additional bit points to the higher energy half.

The coefficients of groups that receive high enough bit-allocation are quantized using a non-uniform symmetric quantizer. The quantizer matches the distribution of the normalized MDCT coefficients. Then Huffman coding is applied to the quantization levels. Illustratively, the Huffman coding is performed on pairs. Several different tables are available, and the Huffman table that best reduces the information size is selected and designated on the bitstream by a corresponding Huffman table index, for each Huffmann-encoded group. The bitrate is tuned as follows. The process of scalar quantization and Huffman coding is carried out in a loop over a list of quantization step size parameters, and the step size parameter that best matches the bit allocation is selected and coded on the bitstream. This is done for each Huffmann-encoded group.

The last detail of the quantization scheme in the preferred embodiment is the masking curve quantization. In this embodiment, a predictive approach is used that makes use of the high inter-frame correlation of the masking curve, especially for the low delay case. For the purpose of channel error handling, the bit allocation information is coded separately and independently of other frames. This separate coding can be avoided by coding the energy envelope only, in a non-predictive manner, and deriving both the masking and the bit allocation from this envelope, simultaneously at the encoder and the decoder. The gain of predictive coding, in terms of required bits, is higher than the cost of sending the additional information for bit allocation. An additional advantage of the present approach is that better accuracy is available for the masking curve and bit allocation, as compared to the case of calculating them from a quantized envelope.

Illustratively, the masking curve is calculated over 18 points equally spaced in Bark scale. The masking energy values are expressed in dB. The quantization steps are as follows, where all the numbers designate energies in dB.

The average value of the 18 numbers is quantized in six bits and coded as the gain of the signal. The quantized gain is subtracted from the series of 18 numbers, resulting in normalized masking curve.

A universal pre-determined curve is subtracted from the normalized curve. This universal series represents a long-term average masking curve over a typical set of audio signals. The result is referred to as the short-term masking curve.

A prediction curve is subtracted from the short-term masking curve. The prediction series is the quantized short-term masking curve of the previous frame multiplied by a prediction gain coefficient Alpha, where Alpha is a constant, typically 0.8 to 0.9.

The prediction error is vector quantized.

Illustratively, gain-shape split VQ of three vectors of length six may be used. Sufficient accuracy is achieved at less than 20 bits, excluding the six bit gain code.

During decoding, the reverse operations are performed.

There has been described a method of processing an ordered time series of signal samples divided in to ordered blocks, referred to as frames, the method comprising, for each said frame, the steps of: (a) transforming the said signal of the said frame in to set of coefficients using overlap or non-overlap transform, the said coefficients are the signal transform; (b) subtracting from the said signal transform a prediction transform to get a prediction error transform; (c) quantizing the said prediction error transform, to get quantization data and bitstream; (d) parsing the said bitstream and the said quantization data to get quantized prediction error transform; (e) add the said quantized prediction error transform to the said prediction transform to get quantized signal transform; (f) inverse transforming the said quantized signal transform using inverse transform of the said transform, to get a quantized signal of the said frame; (g) searching for pitch value of the said frame over the said signal or a filtered version of it, to get an open loop pitch of the said frame; (h) searching for the best combination of closed loop pitch and predictor vector of the said frame based on periodic extension of the said quantized signal, or a filtered version of the said periodic extension; (i) using the said best combination of closed loop pitch and predictor vector to calculate a prediction signal; (j) transforming the said prediction signal using the said transform to get the said prediction transform.

The prediction transform can be subtracted from selected parts of the said signal transform, still referred to as prediction error transform, and said quantized prediction error transform can be added to the said prediction transform only in selected parts, still referred to as quantized signal transform.

The search for the best combination of closed loop pitch and predictor vector, can be over a set of values in the neighborhood of the said open loop pitch of the said frame, and over a set of predictor vectors, such that the error energy between the said signal and the prediction from the said periodic extension of the said quantized signal, or a filtered versions of said signal and the said periodic extension, is minimized.

The subtraction of the said prediction transform from the said signal transform can be switched on and off based on the expected gain from switching it on.

If the said subtraction is switched off, the said quantization can be applied to the said signal transform rather than to the said prediction error transform, to get the said quantized signal transform.

The subtraction may be applied only in parts, where the prediction gain exceeds some thresholds.

The prediction signal can be calculated in different segments for respectively different segments of the signal, referred to as sub-frames, and the search for the best combination of closed loop pitch and predictor vector, can be applied to the sub-frames.

There has also been described a method of processing an ordered sequence of transform coefficients corresponding to a frame, comprising the steps of: (a) calculating a masking threshold sequence from quantized masking curve, and dividing the said transform sequence coefficients by the said masking threshold sequence, where each frequency coefficient is divided by the respective frequency threshold value, to get a normalized transform sequence; (b) grouping the said normalized transform coefficients or part of them in to several groups, each group comprising at least one coefficient; (c) allocating the available bits for the quantization of the said normalized transform coefficients among all said group, such that the expected quantization noise energy of each said group, normalized to the said group size, is equal among all said groups, to get a preliminary bit allocation to the said groups; (d) quantizing the said preliminary bit allocation, using vector quantization or other techniques, to get a quantized bit allocation; (f) applying some constraints to the said quantized bit allocation to get a decoded bit allocation to the said groups; (g) performing vector quantization of the said normalized transform coefficients, for each said group which receives low said decoded bit allocation; (h) performing scalar quantization followed by entropy coding of the said normalized transform coefficients, for each said group which receives high said decoded bit allocation; (i) decoding the packed quantization data to get quantized normalized transform coefficients, and multiplying the said quantized normalized transform coefficients by the said masking threshold sequence, where each frequency coefficient is multiplied by the respective frequency threshold value, to get a quantized transform sequence.

The group can receive said low decoded bit allocation, if the number of said decoded allocated bits per coefficient does not exceed some threshold, which may be dependent on the specific said group.

The group can receive said high decoded bit allocation, if the number of said decoded allocated bits per coefficient exceeds some threshold, which may be dependent on the specific said group.

Each said group may be further sub-divided in to sub-groups for fine tuning of the said decoded bit allocation within the said group.

The said vector quantization of the said normalized transform coefficients can be implemented using gain-adaptive VQ, or gain-shape VQ, where the gain value of the said gain-adaptive VQ, or the said gain-shape VQ, is calculated from the said quantized bit allocation.

Each said group that is quantized via said scalar quantization followed by entropy coding, this quantization can comprise the steps of: (a) for a given quantizer step size parameter, applying uniform or non-uniform scalar quantization to the said normalized transform coefficients which belong to the said group, to get quantization levels; (b) performing Huffman coding of the said quantization levels over sub-groups of the said coefficients of the said group, and counting the resulting used bits; (c) tuning the bitrate by repeating the said scalar quantization followed by the said Huffman coding, while going over a table of step size parameters, and selecting the said step size parameter that best matches the required said decoded bit allocation for the said group.

The Huffman coding can be replaced by another entropy coding technique.

There has also been described a method of quantizing a masking curve, to get the said quantized masking curve, the method comprising the steps of: (a) subtracting the quantized average value of given a sequence of masking values, expressed in dB, from the said sequence of masking values, to get normalized masking sequence; (b) coding the said quantized average value as signal gain of the said frame; (c) subtracting a predetermined universal masking sequence from the said normalized masking sequence, to get the short-term masking sequence; (d) subtracting a prediction sequence from the said short-term masking sequence, the said prediction sequence is based on quantized short-term masking sequences of previous frames, to get the prediction error masking sequence; (e) quantization of the said prediction error masking sequence, using vector quantization or other techniques, to get the quantized prediction error sequence, (f) adding the said quantized prediction error sequence to the said prediction sequence, resulting in the said quantized short-term masking sequence; adding the said universal masking sequence and the said quantized average value, to the said quantized short-term masking sequence, to get the said quantized masking curve.

It will be understood that the above described coding system may be implemented as either software or hardware or any combination of the two. Portions of the system which are implemented in software may be marketed in the form of, or as part of, a software program product which includes suitable program code for causing a general purpose computer or digital signal processor to perform some or all of the functions described above.

A method for exploiting the periodicity of certain audio signals in order to enhance the performance of audio transform coders, has been presented. The method makes use of time domain pitch predictor to calculate a prediction for the current input signal segment. The prediction signal is then transformed to get a transform domain prediction for the input signal transform. The actual coding is applied to the prediction error of the transform, thereby allowing for lower quantization noise for a given bitrate. The method is useful for any type of transform coding and any kind of periodic signal, provided that the signal periodic nature is present along two consecutive transform frames.

It will be understood that the above described coding system may be implemented as either software or hardware or any combination of the two. Portions of the system which are implemented in software may be marketed in the form of, or as part of, a software program product which includes suitable program code for causing a general purpose computer or digital signal processor to perform some or all of the functions described above.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. Apparatus for digitally encoding an input audio signal, for storage or transmission, comprising:

pitch detection means for determining at least a dominant time-domain periodicity in the input signal;

means for generating a prediction signal based on the dominant time domain periodicity of the input signal;

first discrete frequency domain transform means for generating a frequency domain representation of the input signal;

second discrete frequency domain transform means for generating a frequency domain representation of the prediction signal;

means to subtract at least a portion of the frequency domain representation of the prediction signal from the frequency domain representation of the input signal to generate an error signal; and means to generate an output signal from the error signal and parameters defining the prediction signal.

2. Apparatus as claimed in claim 1 wherein the output signal generating means comprises a quantizer for quantizing the error signal.

3. Apparatus as claimed in claim 2 wherein the quantizer comprises means for calculating a masking threshold sequence that represents an amplitude bound for quantization noise in the frequency domain and means to divide frequency domain coefficients of the error signal by the masking threshold sequence to obtain normalized coefficients, and wherein the output signal includes information defining the masking threshold sequence.

4. Apparatus as claimed in claim 3 wherein the information defining the masking threshold sequence is obtained at least in part by subtracting from the masking threshold sequence a predictor masking threshold sequence.

5. Apparatus as claimed in claim 4 wherein the predictor masking threshold sequence is derived from the combination of a pre-determined curve representing a long-term average masking curve over a typical set of audio signals and a masking threshold sequence previously derived from the input signal.

6. Apparatus as claimed in claim 3 wherein the quantizer is arranged to group the normalized coefficients into frequency subbands, to allocate available bits in the output signal to the subbands at least in a preliminary bit allocation so that the expected quantization noise energy of each subband is at least approximately equal and to quantize the normalized coefficients of each subband using the allocated bits for that subband.

7. Apparatus as claimed in claim 6 arranged to vector quantize the preliminary bit allocation to generate the number of allocated bits for each subband.

8. Apparatus as claimed in claim 7 wherein the quantizer is arranged to quantize at least some of the subbands using gain adaptive vector quantization or gain shape vector quantization, a gain value being calculated from said quantized bit allocation.

9. Apparatus as claimed in claim 8 arranged to subdivide at least one of the subbands for fine tuning of the bit allocation within the subband.

10. Apparatus as claimed in claim 7 wherein the quantizer is arranged to quantize the normalized coefficients for each subband using scalar quantization followed by entropy coding if the number of bits allocated to that subband exceeds a threshold or vector quantization if the number of bits allocated to that subband does not exceed the threshold.

11. Apparatus as claimed in claim 1 wherein the input signal comprises a set of signal samples arranged in frames and wherein the apparatus is arranged to enable or disable the subtraction of the prediction signal from the input signal according to an estimation of the likely coding gain to be derived therefrom and wherein the output signal includes an indication for each frame as to whether the prediction signal has been subtracted from the input signal.

12. Apparatus for decoding a digitally encoded audio signal, the digitally encoded audio signal comprising at least parameters defining a prediction signal and an encoded error signal, the apparatus comprising:

means for generating a prediction signal from the parameters;

discrete frequency domain transform means for generating a frequency domain representation of the prediction signal;

means to add at least a portion of the frequency domain representation of the prediction signal to the error signal to generate a frequency domain representation of the audio signal;

inverse discrete frequency domain transform means for regenerating the audio signal from its frequency domain representation.

13. Apparatus as claimed in claim 12 wherein the error signal is quantized and the apparatus comprises a dequantizer for dequantizing the error signal.

14. A method for digitally encoding an input audio signal, for storage or transmission, comprising:

determining at least a dominant time-domain periodicity in the input signal;

generating a prediction signal based on the dominant time domain periodicity of the input signal;

generating a frequency domain representation of the input signal using a discrete frequency domain transform;

generating a frequency domain representation of the prediction signal using a discrete frequency domain transform;

subtracting at least a portion of the frequency domain representation of the prediction signal from the frequency domain representation of the input signal to generate an error signal; and generating an output signal from the error signal and parameters defining the prediction signal.

15. A method for decoding a digitally encoded audio signal, the digitally encoded audio signal comprising at least parameters defining a prediction signal and an encoded error signal, the method comprising:

generating a prediction signal from the parameters;

generating a frequency domain representation of the prediction signal using a discrete frequency domain transform;

adding at least a portion of the frequency domain representation of the prediction signal to the error signal to generate a frequency domain representation of the audio signal; and regenerating the audio signal from its frequency domain representation using an discrete inverse frequency domain transform.

16. A coded representation of an audio signal produced using a method as claimed in claim 14 and stored on a physical medium.

17. Apparatus for digitally encoding an input audio signal, for storage or transmission, comprising:

a pitch detector to determine at least a dominant time-domain periodicity in the input signal;

a first generator to generate a prediction signal based on the dominant time domain periodicity of the input signal;

a first discrete frequency domain transform generator to generate a frequency domain representation of the input signal;

a second discrete frequency domain transform generator to generate a frequency domain representation of the prediction signal;

a subtractor to subtract at least a portion of the frequency domain representation of the prediction signal from the frequency domain representation of the input signal to generate an error signal; and a second generator to generate an output signal from the error signal and parameters defining the prediction signal.

18. Apparatus as claimed in claim 17 wherein the second generator comprises a quantizer for quantizing the error signal.

19. Apparatus as claimed in claim 18 wherein the quantizer comprises a calculator to calculate a masking threshold sequence that represents an amplitude bound for quantization noise in the frequency domain and a frequency divider to divide frequency domain coefficients of the error signal by the masking threshold sequence to obtain normalized coefficients, and wherein the output signal includes information defining the masking threshold sequence.

20. Apparatus as claimed in claim 19 wherein the information defining the masking threshold sequence is obtained at least in part by subtracting from the masking threshold sequence a predictor masking threshold sequence.

21. Apparatus as claimed in claim 20 wherein the predictor masking threshold sequence is derived from the combination of a pre-determined curve representing a long-term average masking curve over a typical set of audio signals and a masking threshold sequence previously derived from the input signal.

22. Apparatus as claimed in claim 19 wherein the quantizer is arranged to group the normalized coefficients into frequency subbands, to allocate available bits in the output signal to the subbands at least in a preliminary bit allocation so that the expected quantization noise energy of each subband is at least approximately equal and to quantize the normalized coefficients of each subband using the allocated bits for that subband.

23. Apparatus as claimed in claim 22 arranged to vector quantize the preliminary bit allocation to generate the number of allocated bits for each subband.

24. Apparatus as claimed in claim 23 wherein the quantizer is arranged to quantize at least some of the subbands using gain adaptive vector quantization or gain shape vector quantization, a gain value being calculated from said quantized bit allocation.

25. Apparatus as claimed in claim 24 arranged to subdivide at least one of the subbands for fine tuning of the bit allocation within the subband.

26. Apparatus as claimed in claim 23 wherein the quantizer is arranged to quantize the normalized coefficients for each subband using scalar quantization followed by entropy coding if the number of bits allocated to that subband exceeds a threshold or vector quantization if the number of bits allocated to that subband does not exceed the threshold.

27. Apparatus as claimed in claim 17, wherein the input signal comprises a set of signal samples arranged in frames and wherein the apparatus is arranged to enable or disable the subtraction of the prediction signal from the input signal according to an estimation of the likely coding gain to be derived therefrom and wherein the output signal includes an indication for each frame as to whether the prediction signal has been subtracted from the input signal.

28. Apparatus for decoding a digitally encoded audio signal, the digitally encoded audio signal comprising at least parameters defining a prediction signal and an encoded error signal, the apparatus comprising:

a first generator to generate a prediction signal from the parameters;

a discrete frequency domain transform generator to generate a frequency domain representation of the prediction signal;

an adder to add at least a portion of the frequency domain representation of the prediction signal to the error signal to generate a frequency domain representation of the audio signal;

an inverse discrete frequency domain transform regenerator for regenerating the audio signal from its frequency domain representation.

29. Apparatus as claimed in claim 28 wherein the error signal is quantized and the apparatus comprises a dequantizer for dequantizing the error signal.

30. A computer program product for digitally encoding an input audio signal for storage or transmission, said computer program product comprising a computer usable medium having computer readable program code thereon, said computer readable program code comprising:

computer readable program code means for determining at least a dominant time-domain periodicity in the input signal;

computer readable program code means for generating a prediction signal based on the dominant time domain periodicity of the input signal;

computer readable program code means for generating a frequency domain representation of the input signal using a discrete frequency domain transform;

computer readable program code means for generating a frequency domain representation of the prediction signal using a discrete frequency domain transform;

computer readable program code means for subtracting at least a portion of the frequency domain representation of the prediction signal from the frequency domain representation of the input signal to generate an error signal; and computer readable program code means for generating an output signal from the error signal and parameters defining the prediction signal.

31. A computer program product for decoding a digitally encoded audio signal, the digitally encoded audio signal comprising at least parameters defining a prediction signal and an encoded error signal, the computer program product comprising a computer usable medium having computer readable program code thereon, said computer readable program code comprising:

computer readable program code means for generating a prediction signal from the parameters;

computer readable program code means for generating a frequency domain representation of the prediction signal using a discrete frequency domain transform;

computer readable program code means for adding at least a portion of the frequency domain representation of the prediction signal to the error signal to generate a frequency domain representation of the audio signal; and computer readable program code means for regenerating the audio signal from its frequency domain representation using an discrete inverse frequency domain transform.

* * * * *